US005527558A

United States Patent [19]

Daidoji et al.

[11] Patent Number: 5,527,558

[45] Date of Patent: Jun. 18, 1996

[54] METHOD FOR PREPARATION OF A CARRIER FOR DEVELOPING AN ELECTROSTATIC CHARGE IMAGE

[75] Inventors: Tsuneo Daidoji; Kishio Tamura; Masafumi Uchida, all of Hachioji, Japan

[73] Assignee: Konica Corporation, Japan

[21] Appl. No.: 315,756

[22] Filed: Sep. 30, 1994

[30] Foreign Application Priority Data

Oct. 8, 1993 [JP] Japan ..... 5-253468

[51] Int. Cl.[6] ..... B05D 7/00

[52] U.S. Cl. ..... 427/221; 430/108; 430/111; 430/137

[58] Field of Search ..... 430/108, 111, 430/137; 427/221; 252/62.54

[56] References Cited

U.S. PATENT DOCUMENTS

| | | | |
|---|---|---|---|
| 4,233,387 | 11/1980 | Mammino et al. | 427/221 |
| 5,168,027 | 12/1992 | Taguchi et al. | 430/108 |
| 5,310,617 | 5/1994 | Taguchi et al. | 430/108 |
| 5,350,656 | 9/1994 | Kouno et al. | 430/108 |
| 5,374,978 | 12/1994 | Asanae et al. | 355/210 |
| 5,376,488 | 12/1994 | Ohmura et al. | 430/108 |

FOREIGN PATENT DOCUMENTS

| | | | |
|---|---|---|---|
| 60-186865 | 9/1985 | Japan | 430/111 |
| 4-139459 | 5/1992 | Japan | 430/111 |
| 4-175769 | 6/1992 | Japan | 430/111 |

*Primary Examiner*—Shrive Beck
*Assistant Examiner*—Katherine A. Bareford
*Attorney, Agent, or Firm*—Jordan B. Bierman; Bierman and Muserlian

[57] ABSTRACT

A method for preparing a carrier for developing an electrostatic charge image, wherein the carrier comprises core particles each having thereon a resin coated layer, and a volume base average particle diameter D50 of the core particles is within the range of 40 to 80 μm, and 5 wt % or less of the core particles have a volume base average particle diameter D50×1.2 μm or more and 5 wt % or less of the core particles have a volume base average particle diameter D50×0.7 μm or less, comprising the steps of forming a mixture of the core particles and coagulated resin particles; applying an impact force repeatedly to said mixture to coat said coagulated resin particles on said core particles; wherein a volume base average particle diameter D50 of the coagulated resin particles is within the range of 0.5 to 20 μm, and a ratio of a volume base 25% particle diameter of the coagulated resin particles/a volume base average particle diameter D50 of the coagulated resin particles is within the range of 0.5 to 1.0, and a ratio of a volume base 75% particle diameter of the coagulated resin particles/a volume base average particle diameter D50 of the coagulated resin particles is within the range of 1.0 to 1.8.

5 Claims, 3 Drawing Sheets

METHOD FOR PREPARATION OF A CARRIER FOR DEVELOPING AN ELECTROSTATIC CHARGE IMAGE

FIELD OF THE INVENTION

The present invention relates to a resin-coated carrier for developing an electrostatic charge image.

BACKGROUND OF THE INVENTION

In general, a two-component developer used for an electrophotography is composed of non-magnetic toner and a magnetic carrier both of which are mixed together, and the carrier mentioned above gives necessary magnetism and appropriate electric charges to the toner through friction with the toner and it also has a function as a toner-carrier to attract toner electrostatically for conveying the toner.

As the carrier mentioned above, a resin-coated carrier wherein the surface of a magnetic core particle is covered with resin is valued highly from the viewpoint of durability and improvement in a property of triboelectrification.

As a method for forming a coating layer of the above-mentioned resin-coated carrier, there is available a wet method such as a method for spraying on a core particle a solution in which resin for coating is dissolved or dispersed or a method for soaking a core particle in the aforementioned solution. However, the wet method requires a long production time, provides poor yield and hardly offers coating layers in high quality.

With the background mentioned above, Japanese Patent Publication Open to Public Inspection No. 235965/1988 (hereinafter referred to as Japanese Patent O.P.I. Publication) discloses a technology for forming a resin-coated layer wherein the surface of a core particle composed of resin-powder-dispersed particles each having a weight average particle diameter of 20–200 μm is coated with resin fine particles each having a particle diameter that is one tenth of that of the carrier or lower by means of a dry coating method, for obtaining a carrier for developing an electrostatic charge image.

On the other hand, Japanese Patent O.P.I. Publication No. 269544/1991 discloses a technology for forming a resin-coated layer wherein a coagulated substance having a volume base average particle diameter of 1.5–5.0 μm composed of a plurality of primary fine particles each having a volume base average particle diameter of 0.5 μm or less is stuck on the surface of a magnetic core particle through a dry coating method.

In the case of the technologies disclosed in the publications above, however, breakdown of a core particle caused by collision between core particles takes place when forming a coating layer by fixing resin particles on the surface of the core particle by means of a dry coating method, because only ranges of particle diameter of both a core particle and a resin fine particle for use in coating are watched for forming resin-coated carriers.

The aforesaid breakdown caused by collision between core particles results naturally in an occurrence of fine carrier particles which adhere to an image-forming unit and deteriorate image quality when they are used for image formation. Therefore, the aforesaid breakdown of a core particle is one of problems in the dry coating method for producing resin-coated carriers.

For solving the problem mentioned above, there have been proposed methods for easing the conditions on an apparatus including a method for lowering the peripheral speed for stirring in the course of dry coating. However, this has a problem that the layer-forming efficiency is lowered, or isolating resin fine particles stay and are contained in a carrier to adversely affect an image, and effective measures to solve the problem have not been found yet at this stage.

The inventors found, after their intensive study, that the problem mentioned above can be solved by the method wherein a range of particle diameter and a range of particle diameter distribution both for a core particle and a resin fine particle used for forming a coating layer on the surface of the core particle are regulated when forming resin-coated carriers through a dry coating method, and the core particles and the resin fine particles both having the regulated appropriate range of particle diameter and sharp distribution of particle diameter are used for forming carriers. Thus, the invention has been accomplished.

The present invention has been proposed based on the situation mentioned above, and an object of the invention is to provide a carrier for developing an electrostatic charge image wherein resin fine particles are fixed evenly and firmly to a magnetic core particle without any breakdown thereof through a dry coating method for the formation of a resin coating layer, and thereby no carrier fixes to an image-forming unit when forming an image and no white spot is caused and images with high image quality can be obtained stably for a long time.

SUMMARY OF THE INVENTION

The object of this invention is, therefore, to provide a method for preparing a carrier for developing an electrostatic charge image, wherein the carrier comprises core particles each having thereon a resin coated layer, and a volume base average particle diameter $D_{50}$ of the core particles is within the range of 40 to 80 μm, and 5 wt % or less of the core particles have a volume base average particle diameter $D_{50}\times1.2$ μm or more and 5 wt % or less of the core particles have a volume base average particle diameter $D_{50}\times0.7$ μm or less, comprising the steps of:

forming a mixture of the core particles and coagulated resin particles;

applying an impact force repeatedly to said mixture to coat said coagulated resin particles on said core particles, wherein a volume base average particle diameter $D_{50}$ of the coagulated resin particles is within the range of 0.5 to 20 μm, and a ratio of a volume base 25% particle diameter $D_{25}$ of the coagulated resin particles/a volume base average particle diameter $D_{50}$ of the coagulated resin particles is within the range of 0.5 to 1.0, and a ratio of a volume base 75% particle diameter $D_{75}$ of the coagulated resin particles/a volume base average particle diameter $D_{50}$ of the coagulated resin particles is within the range of 1.0 to 1.8.

Explanation of symbols

10. Container
11. Top cover
12. Raw material inlet
16. Thermometer
17. Jacket
18*a*, 18*b*, 18*c*. Stirring blades
18. Horizontal rotor
19. Vertical rotor

DETAILED DESCRIPTION OF THE INVENTION

The dry coating method means a method wherein mechanical impact force is given repeatedly to the mixture of resin fine particles and core materials so that a resin film may be formed on the surface of the core material. Incidentally, the aforesaid mixture may further be heated when it is given the mechanical impact force.

As a core particle to be used for the invention, iron, magnetite and ferrite, for example, are used, and ferrite is preferable in particular on the points of appropriate magnetization and specific gravity.

Ferrite mentioned in this case can be represented by a chemical formula of $MO.Fe_2O_3$ (M represents a divalent metal such as copper, zinc, iron, nickel, cobalt, magnesium and manganese). This compound is preferable on the point that impact energy acting between core particles during dry coating can be made small due to its specific gravity which is relatively small.

Among them, those having specific gravity of 2.0–6.0 are especially preferable.

Figure 1:
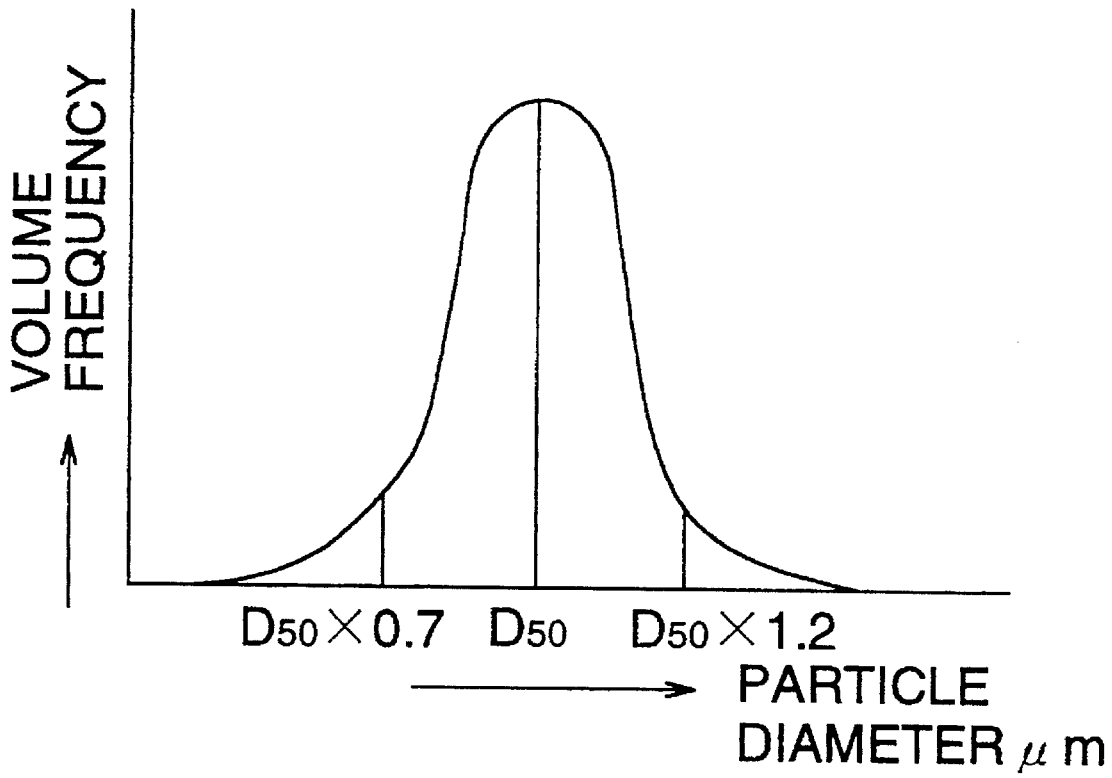
FIG. 1 represents a characteristics diagram showing the volume particle diameter distribution of core particles.

In the present invention, as shown in FIG. 1, a volume base average particle diameter $D_{50}$ of the core particles is within the range of 40 to 80 μm, and 5 wt % or less of the core particles have a volume base average particle diameter $D_{50}\times1.2$ μm or more, and 5 wt % or less of the core particles have a volume base average particle diameter $D_{50}\times0.7$ μm or less.

When $D_{50}$ of the core particle is less than 40 μm in this case, carriers tend to fix to an image-forming unit during image formation, and they damage the image-forming unit to cause image defect. When it exceeds 80 μm, the specific surface area is small and sufficient triboelectrification can not be provided to toner and image defect such as gray background is caused.

Further, when particles on the larger side of $D_{50}\times1.20$ μm or more in terms of core particle exceed 5 wt % and particles on the smaller side of $D_{50}\times0.7$ μm or less exceed 5 wt %, namely, when the core particles have a broader particle diameter distribution, breakdown of core particles caused by impact force acting between particles tends to take place, resulting in occurrence of carrier scattering and carrier adhesion in image forming.

When regulating core particles used in carrier production to the desired range of particle diameter and particle diameter distribution, it can be accomplished by adjusting the velocity of air of the known air classifier or by selecting a mesh of a screening device.

Coagulated resin fine particle coagulated substances used for forming a resin-coated layer on the surface of the core particle mentioned above can be obtained through the known polymerization methods such as, for example, a suspension polymerization method, an emulsion polymerization method, a bulk polymerization method and a block polymerization method. It is usually obtained as an coagulated substance of fine primary particles of 0.5 μm or less in size.

As resin used for the resin particles mentioned above, any resin such as, for example, styrene resin, acrylic resin, styrene-acrylic copolymer resin, vinyl resin, ethylene resin, polyamide resin or polyester resin can be used.

Figure 2:
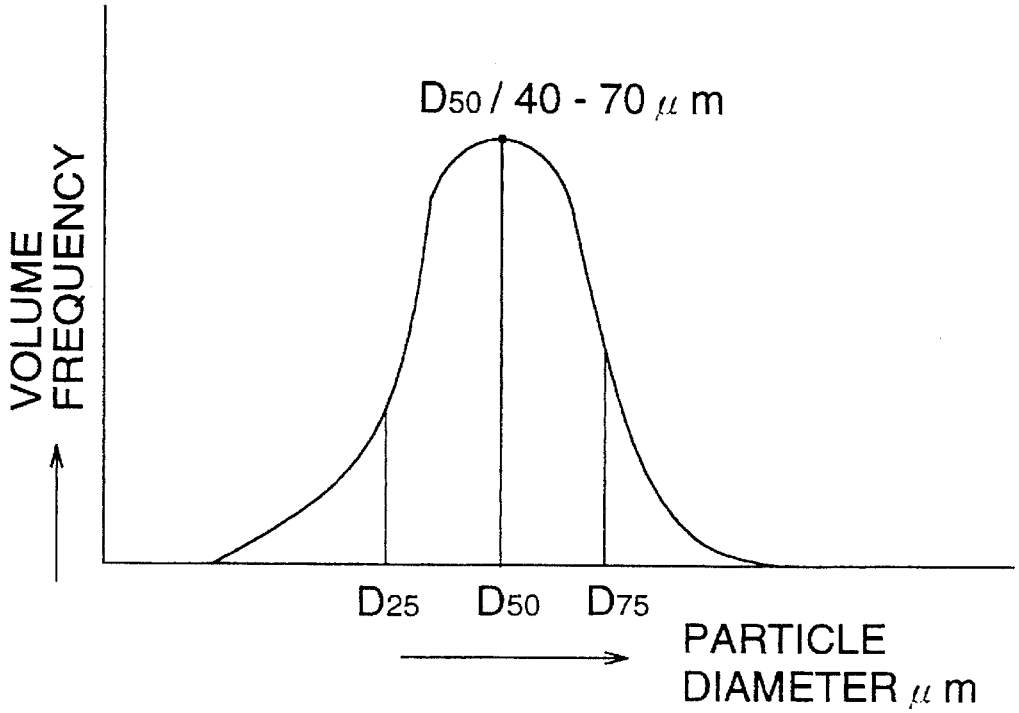
FIGS. 2A and 2B represent a characteristics diagram showing the volume standard particle diameter distribution and a characteristics diagram showing the volume standard cumulative particle diameter distribution.
Figure 2:
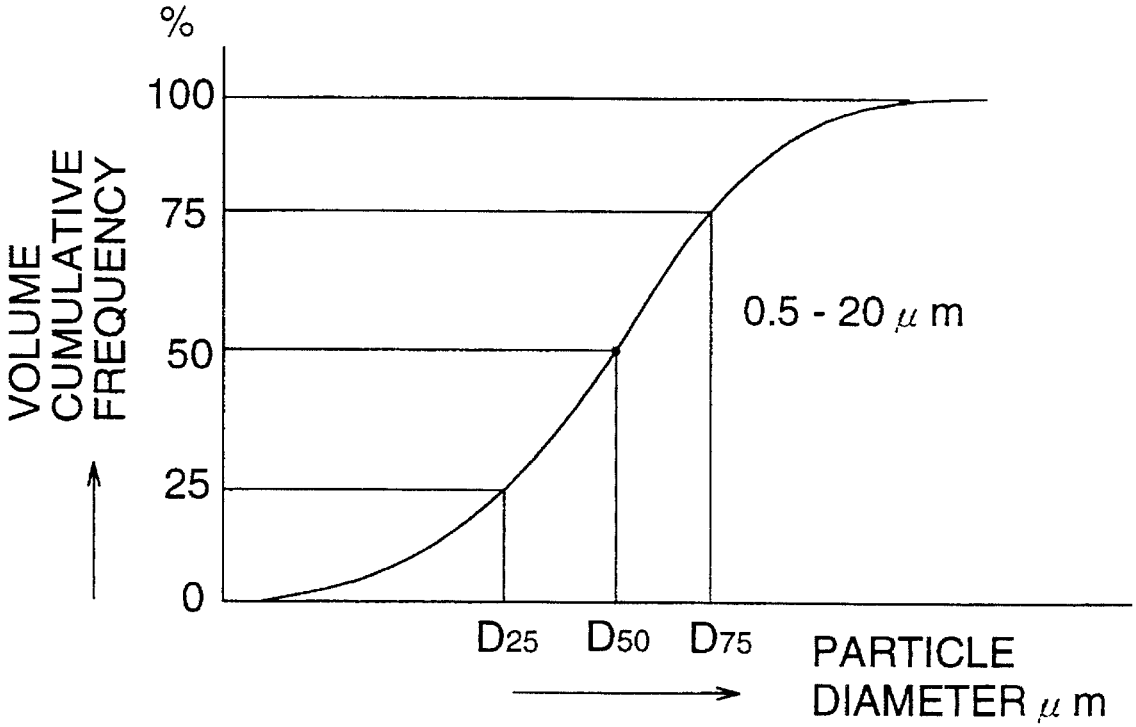

With regard to the aforementioned resin fine particle coagulated substance in the invention, the volume base average particle diameter $D_{50}$ shown in FIG. 2(*a*) or (*b*) is within a range of 0.5–20 μm, ratio $D_{25}/D_{50}$ of volume 25% particle diameter $D_{25}$ to $D_{50}$ is 0.5–1.0 and ratio $D_{75}/D_{50}$ of volume 75% particle diameter $D_{75}$ to $D_{50}$ is 1.0–1.8.

When $D_{50}$ of the above-mentioned coagulated resin fine particle is less than 0.5 μm, the particles scatter in the course of dry-coating and fix to the inner wall of an apparatus, resulting in much loss. In addition, isolating particles remain, and thereby white spots tend to occur and uniform coating layers can not be obtained. Also in the case when $D_{50}$ exceeds 20 μm, uniform coating layers can not be obtained again and isolating particles remain to be the cause for white spots.

In the invention, the range of 1.0–10 μm is preferable for $D_{50}$ of the aforesaid coagulated resin fine particle used for forming a uniform coating layer with core particles.

When $D_{25}/D_{50}$ of the aforesaid resin fine particle is less than 0.5, a group of particles belonging to the smaller size prevents the resin fine particles from being arranged uniformly on the magnetic particles, resulting in the increase of breakdown of the magnetic particles caused by their collision with each other. When $D_{75}/D_{50}$ exceeds 1.8, a group of particles belonging to the larger size prevents the resin fine particles from being arranged uniformly on the magnetic particles, resulting in the increase of breakdown of the magnetic particles. Further, large-sized particles increase in number and a coating layer tends not to be formed and isolating resin fine particles increase in number.

Incidentally, FIG. 1 shows volume base particle diameter distribution of core particles, FIG. 2(A) shows volume base particle diameter distribution of resin fine particles and FIG. 2(B) shows volume base cumulative particle diameter distribution. In each figure, the axis of abscissas represents a particle diameter in μm, while, the axis of ordinates represents respectively volume base particle diameter frequency of core particles, volume base particle diameter frequency of resin fine particles and volume base cumulative particle diameter frequency.

In FIGS. 1, 2A, and 2B, $D_{50}$ represents the particle diameter which is established so that a volume of particles belonging to the side smaller than $D_{50}$ particle diameter is the same as that of particles belonging to the side larger than $D_{50}$, while, $D_{25}$ represents the particle diameter which is established so that a volume of particles belonging to the side smaller than $D_{25}$ particle diameter is 25% of the volume of total particles, and $D_{75}$ represents the particle diameter which is established so that a volume of particles belonging to the side smaller than $D_{75}$ particle diameter is 75% of the volume of total particles.

To regulate the volume base average particle diameter of coagulated resin fine particle, the known crusher can be employed. A crusher employing an air jet such as a jet mill or a turbo-mill is used preferably and it gives good results.

To regulate the particle diameter distribution of resin fine particles, it is possible to use the known air jet classifier such as Microplex or a turbo-classifier.

Incidentally, with regard to a group of magnetic particles and a group of coagulated resin fine particle, it is possible to obtain by using a particle diameter distribution measuring instrument of a laser type "HELOS" (made by Nihon Denshi Co.).

| | |
|---|---|
| Sonication time | 120 sec. |
| Pause | 10 sec. |
| Time of measurement | 15 sec. |
| Method of measurement | Suspension cell |
| Dispersant | Water |

The focal length is changed as follows depending on the range of particle diameter to be measured.

| Range of particle diameter | Focal length |
|---|---|
| 0.1–35 μm | 20 mm |
| 0.25–87.5 μm | 50 mm |
| 0.5–175 μm | 100 mm |

When measuring magnetic particles, no preliminary processing is required.

When measuring resin fine particles, following operations are needed as a preliminary processing.

Resin fine particles weighing 0.05 g are mixed with 50 cc of distilled water to which an appropriate amount of surfactant is added, and they are subjected to supersonic dispersion for 30 seconds in a supersonic dispersing apparatus "homogenizer", as a preliminary processing.

Compared with a wet coating method, a dry coating method used in the invention has many advantageous points including (1) no solvent is used, (2) no air ventilation is needed because no solvent is used and airtight processing can be conducted, (3) processing requires only a short period of time, and (4) adhesion of a coating layer to a core particle is excellent and layer characteristics of a coating layer are excellent.

Figure 3:
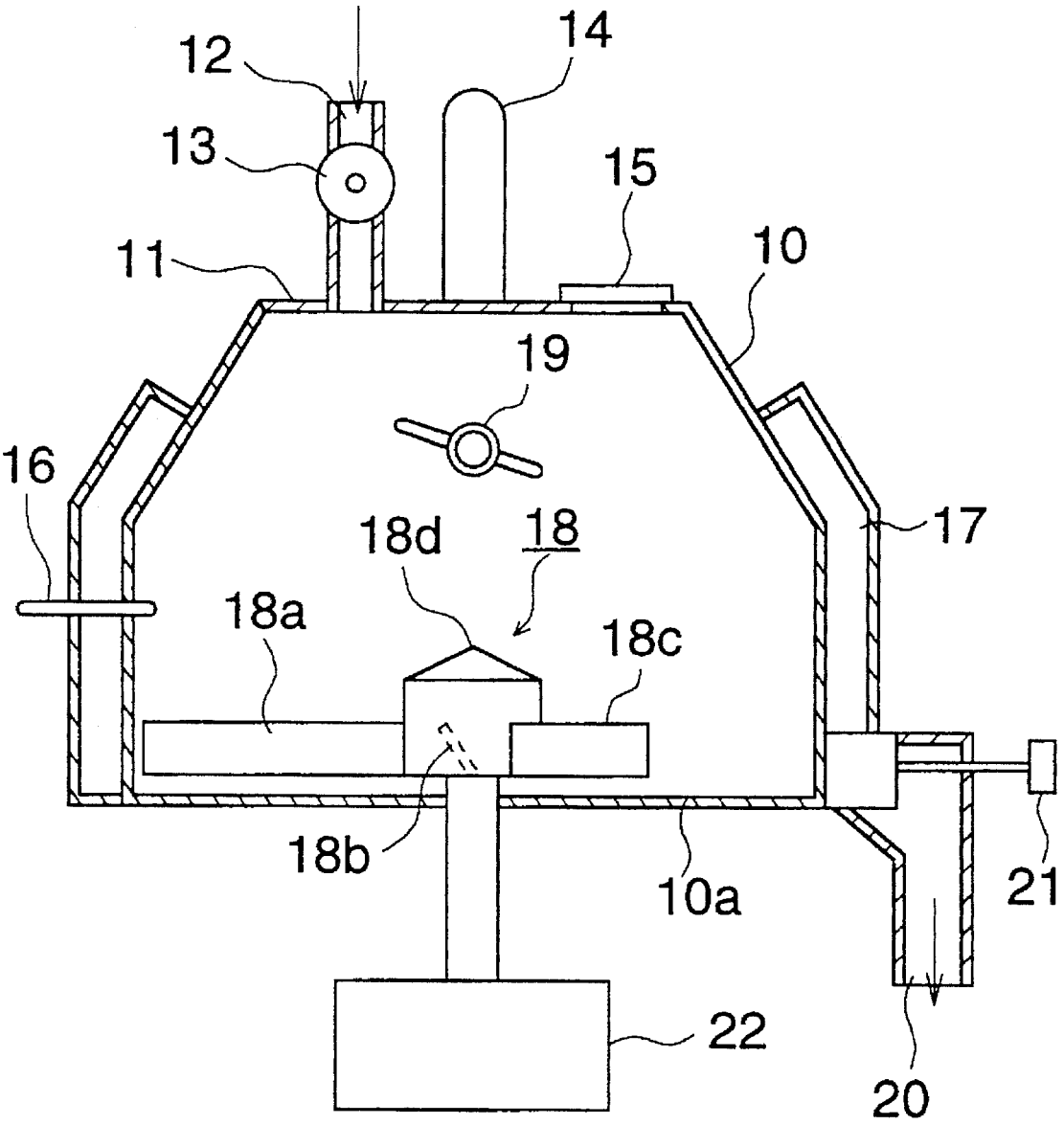
FIG. 3 is a sectional view of a high speed stirring/mixing machine used for producing resin-coated carriers.

As the dry coating method mentioned above, a hybridizer equipped with a rotor and liner (made by Nara Kikai Co.) or the like is used, and a high speed stirring/mixing machine shown in FIG. 3 is preferably used.

In FIGS. 1, 2A, and 2B, the numeral 11 represents a top cover which is equipped with raw material inlet 12, raw material valve 13, filter 14 and observation window 15.

A predetermined amount of core particles and coagulated resin fine particle are added through the raw material inlet 12 and they are stirred by horizontal rotor 18 driven by motor 22. The horizontal rotor 18 is equipped with stirring blades 18*a*, 18*b* and 18*c* which are affixed to center portion 18*d* of the horizontal rotor to be arranged in a radial manner with an angular interval of 120° and to be inclined at 35° to the surface of bottom portion 10*a*. Therefore, when the stirring blades 18*a*, 18*b* and 18*c* mentioned above are rotated at high speed, the aforesaid raw materials are stirred upward to hit the inner wall at the upper portion of container 10 and fall. When they fall, they hit vertical rotor 19 to be stirred.

In order to prevent destruction of core particles caused by their collision and to form a uniform coating layer that is excellent in adhesion when forming a coating layer by the use of the above-mentioned high speed stirring/mixing machine, the following steps (a), (b) and (c) are required and it is preferable that the processing conditions for each step are as follows.

(a) Mixing step: Stirring blades 18*a*, 18*b* and 18*c* are rotated at the peripheral speed of 8 m/sec. or less while cooling water at 10° C.–15° C. is running through jacket 17, and raw materials put into container 10 are stirred and mixed for 10–20 minutes in the container 10 where the temperature is kept at Tg of coagulated resin fine particle or lower, usually at 50° C. or lower.

(b) Layer-forming step: The above-mentioned stirring blades are rotated at the peripheral speed that is the same as or higher than that in the mixing step (a), and warm water is caused to run through the jacket 17 to raise the temperature in the container to Tg of coagulated resin fine particle or higher for stirring and mixing.

(c) Post-layer-forming step: Cold water at 10°–15° C. is caused to run through the jacket 17 for cooling. During that period, the peripheral speed of the aforesaid stirring blades is lowered to that in the layer-forming step or lower for stirring and cooling, and when the temperature is lowered to Tg of coagulated resin fine particle or lower, usually to the temperature of 70° C. or lower, ejection valve 21 is opened to eject the product carriers thus obtained through outlet 20.

In the aforesaid dry coating method, an amount of resin fine particles coated on core particles is preferably 0.1–5% by weight per unit weight of core particle.

(Effect)

A carrier for developing an electrostatic charge image of the invention is formed by coating resin fine particles composed of fine primary particles and having sharp particle diameter distribution on core particles having sharp particle diameter distribution through a dry coating method. Therefore, the core particles are covered evenly and firmly by resin fine particles. In particular, destruction of core particles caused by their collision can be prevented and isolating resin fine particles after processing do not remain, thus, carriers with good quality which are uniform in terms of particle diameter can be obtained.

The reason for the above is supposed to be that impact force on the occasion of collision of core particles is small and thereby destruction thereof can be prevented and resin fine particles can easily adhere evenly and firmly because the core particles have an appropriate range of particle diameter and sharp particle diameter distribution and are uniform in terms of particle diameter. Furthermore, resin fine particles are composed of coagulation material having an appropriate particle diameter, their particle diameter distribution is sharp and they are uniform in terms of particle diameter. Therefore, it is supposed that they adhere to the aforesaid core particles quickly and evenly and thereby they lessen further the impact force of collision of the core particles. Namely, it is supposed that carriers of good quality which are uniform and are free from peeling can be obtained due to synergistic effect of the above-mentioned characteristics of both core particles and resin fine particles.

Therefore, when the carriers mentioned above are used for image forming, it is possible to provide stably an image with good quality wherein carriers do not adhere to an image-forming unit, white spots caused by adhesion of resin powder do not occur, image-forming is not damaged, and a solid black portion is uniform.

EXAMPLE

The invention will be explained in detail as follows, referring to the example to which an embodiment of the invention is not limited.

<Core particles>

Raw core materials composed of CuO—ZnO—$Fe_2O_3$ ferrite were screened by a screening device (made by DALTON Co.) and core particles in 6 kinds including core particles for Example use 1–4 and core particles for Comparative example use 5 and 6 shown in Table 1 were prepared by selecting particle diameters with meshes.

TABLE 1

| Core particles No. | | Characteristics of core particles | | |
|---|---|---|---|---|
| | | $D_{50}$ μm | Rate of containing $D_{50} \times 1.2$ μm particles, % | Rate of containing $D_{50} \times 0.7$ μm particles, % |
| For use in Example | 1 | 40 | 3 | 2 |
| For use in Example | 2 | 50 | 2 | 2 |
| For use in Example | 3 | 60 | 1 | 1 |
| For use in Example | 4 | 80 | 4 | 4 |
| For use in Comparative example | 5 | 60 | 8 | 9 |
| For use in Comparative example | 6 | 50 | 12 | 10 |

<Preparation of resin fine particles>

Resin fine particles of a methacrylic acid ester type having Tg of 110° C. were synthesized through an emulsion polymerization method, and particles obtained therefrom were classified by a MICROPLEX air classifier (made by Hosokawa Co.), thus, coagulated resin fine particle in 6 kinds including those for Example use 1–4 and those for Comparative example use 5 and 6 shown in Table 2 were prepared.

TABLE 2

| Resin fine particle No. | | $D_{50}$ μm | $D_{25}$ μm | $D_{25}/D_{50}$ | $D_{75}$ μm | $D_{75}/D_{50}$ |
|---|---|---|---|---|---|---|
| For use in Example 1 | 1 | 10.2 | 7.3 | 0.72 | 15.2 | 1.48 |
| For use in Example 2 | 2 | 2.3 | 1.3 | 0.57 | 3.9 | 1.70 |
| For use in Example 3 | 3 | 18.5 | 10.2 | 0.55 | 30.5 | 1.65 |
| For use in Example 4 | 4 | 3.9 | 2.4 | 0.62 | 6.2 | 1.59 |
| For use in Comparative example 1 | 5 | 18.5 | 6.3 | 0.34 | 42.5 | 2.30 |
| For use in Comparative example 2 | 6 | 28.5 | 18.6 | 0.65 | 39.6 | 1.39 |

<Preparation of resin-coated carrier>

One each in both core particles in Table 1 and coagulated resin fine particle in Table 2 were selected as shown in Table 3 and they were subjected to dry coating on the high speed stirring/mixing machine shown in FIG. 3 under the processing conditions in Table 3 and Table 4, thus, carriers in 10 kinds including carriers 1–7 for Example use and carriers 8–10 for Comparative example use were obtained.

TABLE 3

| Each particle No. | | | | Mixing step | | |
|---|---|---|---|---|---|---|
| Core particle | | Resin fine particle | Carrier particle | Peripheral speed of stirring blade, m/sec. | Temperature in container, °C. | Processing time minutes |
| For use in Example 1 | 1 | 2 | 1 | 6 | 35 | 15 |
| For use in Example 2 | 2 | 2 | 2 | 4 | 37 | 15 |
| For use in Example 3 | 3 | 2 | 3 | 4 | 37 | 15 |
| For use in Example 4 | 4 | 2 | 4 | 8 | 49 | 15 |
| For use in Example 5 | 3 | 1 | 5 | 4 | 38 | 15 |
| For use in Example 6 | 3 | 3 | 6 | 6 | 45 | 15 |
| For use in Example 7 | 3 | 4 | 7 | 4 | 40 | 15 |
| For use in Comparative example 1 | 5 | 2 | 8 | 4 | 37 | 15 |
| For use in Comparative example 2 | 3 | 5 | 9 | 4 | 42 | 15 |
| For use in Comparative example 3 | 6 | 6 | 10 | 4 | 38 | 15 |

TABLE 4

| Particle No. Carrier particle | Layer-forming step: Peripheral speed of stirring blade, m/sec. | Layer-forming step: Temperature in container, °C. | Layer-forming step: Processing time, minutes | Post-layer-forming step: Peripheral speed of stirring blade, m/sec. | Post-layer-forming step: Temperature in container, °C. | Post-layer-forming step: Processing time, minutes |
|---|---|---|---|---|---|---|
| 1 | 8 | 120 | 30 | 4 | 35 | 15 |
| 2 | 8 | 120 | 30 | 4 | 56 | 15 |
| 3 | 8 | 120 | 30 | 4 | 54 | 15 |
| 4 | 8 | 120 | 30 | 4 | 38 | 15 |
| 5 | 8 | 120 | 30 | 8 | 52 | 15 |
| 6 | 8 | 120 | 30 | 6 | 42 | 15 |
| 7 | 8 | 120 | 30 | 4 | 54 | 15 |
| 8 | 8 | 120 | 30 | 4 | 50 | 15 |
| 9 | 8 | 120 | 30 | 4 | 45 | 15 |
| 10 | 8 | 120 | 30 | 4 | 47 | 15 |

<Preparation of developing agent>

To 100 parts by weight of polyester, 8 parts by weight of carbon black and 2 parts by weight of wax were mixed, kneaded, crushed and classified, and toner particles with an average particle diameter of 8 μm were obtained. These toner particles were divided into 10 groups each weighing 72 g, and toner particles in each group were mixed by a V-type mixing machine with each group of carriers weighing 1728 g among the aforesaid 10 kinds of carriers, thus 10 kinds of developing agents 1–10 corresponding to the aforesaid carriers 1–10 were obtained.

<Image-forming test>

(EXAMPLE 1)

On an electrophotographic V-BIX 5170 copying machine made by Konica Corp. steps of charging—exposure—developing (excluding transferring) were repeated continuously for 3000 cycles under the condition that a white chart in A3 size was placed on a platen glass, developing agent 1 was filled in a developing unit, and bias voltage of 350 V was impressed. After that, an amount of carriers fixing to a photoreceptor was measured, and the results thereof are shown in Table 5. In the example mentioned above, the background potential was set to 100 V. Then, a solid black chart in A3 size was placed on a platen glass and an initial transfer image was obtained through the steps of charging—exposure—developing—transfer under an appropriate aperture, and the number of white spots observed on the size of A3 was measured and the results thereof are shown in Table 5.

(EXAMPLES 2–7)

Next, developing agents 2–7 were filled respectively in developing units and image-forming tests were made respectively in the same manner as in Example 1. Then, an amount of stuck carriers and the number of white spots were measured, and the results thereof are shown in Table 5.

(Comparative examples 1–3)

Next, developing agents 8–10 were filled respectively in the developing units and image-forming tests were made in the same manner as in the examples. Then, an amount of fixed carriers and the number of white spots were measured, and the results thereof are shown in Table 5. Further, the degree of density unevenness on a solid black area caused by isolating resin powder was also evaluated visually, though it was not observed as a white spot. The results thereof are also shown in Table 5.

Incidentally, for the purpose of measuring the amount of fixed carriers mentioned above, fixed substances to the photoreceptor drum were collected by a cleaning blade after developing and only carriers among them were picked up by a magnet and their weight in mg was measured by a chemical balance.

TABLE 5

| Example, Comparative example Nos. | Developing agent No. | Amount of stuck carriers in mg per A3 sheet | Number of white spots per A3 sheet | Evenness on solid black area |
|---|---|---|---|---|
| Example 1 | 1 | 46.8 | 0 | Good |
| Example 2 | 2 | 38.0 | 0 | Excellent |
| Example 3 | 3 | 29.1 | 0 | Excellent |
| Example 4 | 4 | 50.0 | 0 | Good |
| Example 5 | 5 | 49.5 | 0 | Good |
| Example 6 | 6 | 49.1 | 0 | Good |
| Example 7 | 7 | 25.9 | 0 | Excellent |
| Comparative example 1 | 8 | 262.5 | 0 | Bad |
| Comparative example 2 | 9 | 210.0 | 27 | Bad |
| Comparative example 3 | 10 | 509.9 | 33 | Bad |

It is understood from Table 5 that developing agents containing the carriers of the invention show not only less amount of fixed carriers and less occurrence of white spots but also excellent evenness on a solid black area, while, Comparative examples show that image quality can not be put to practical use due to considerable amount of fixed carriers and of white spots.

EFFECT OF THE INVENTION

As is apparent from the above explanation, carriers for developing an electrostatic charge image of the invention wherein both core particles and coagulated resin fine particle prepared through a dry coating method have an appropriate range of particle diameter and a sharp distribution of particle diameter have an effect that images which are free from image defects such as carrier fixing and white spots after many use and are highly durable with high image quality can be obtained.

What is claimed is:

1. A method for preparing a carrier for developing an electrostatic charge image, wherein the carrier comprises core particles each having thereon a resin coated layer, and a volume base average particle diameter $D_{50}$ of the core particles is within the range of 40 to 80 μm, and 5 wt % or less of the core particles have a volume base average particle diameter $D_{50}\times1.2$ μm or more and 5 wt % or less of the core particles have a volume base average particle diameter $D_{50}\times0.7$ μm or less, comprising the steps of:

forming a mixture of the core particles and coagulated resin particles;

applying an impact force repeatedly to said mixture to coat said coagulated resin particles on said core particles, wherein a volume base average particle diameter $D_{50}$ of the coagulated resin particles is within the range of 0.5 to 20 μm, and a ratio of a volume base 25% particle diameter $D_{25}$ of the coagulated resin particles/a volume base average particle diameter $D_{50}$ of the coagulated resin particles is within the range of 0.5 to 1.0, and a ratio of a volume base 75% particle diameter $D_{75}$ of the coagulated resin particles/a volume base average particle diameter $D_{50}$ of the coagulated resin particles is within the range of 1.0 to 1.8.

2. The method of claim 1, wherein said method further comprises a step of cooling said core particles coated with said coagulated resin particles after said impact force applying step.

3. The method of claim 2, wherein a peripheral speed $V_1$, a peripheral speed $V_2$ and a peripheral speed $V_3$ satisfy the following Formula 1 and 2:

Formula 1: $V_1 \leqq 8$ m/s:

Formula 2: $V_1 \leqq V_2 \leqq V_3$ wherein $V_1$ is a peripheral speed of a stirring blade in Said mixture forming step, $V_2$ is a peripheral speed of said stirring blade in said applying step, and $V_3$ is a peripheral speed of said stirring blade in said cooling step.

4. The method of claim 1, wherein the volume base average particle diameter $D_{50}$ of the coagulated resin particles is within the range of 1.0 to 10 μm.

5. The method of claim 1, wherein an amount of the coagulated resin particles coated on the core particles is within the range of 0.1 to 5% by weight per unit weight of the core particles.

* * * * *